US005634180A

United States Patent [19]

Michlin et al.

[11] Patent Number: 5,634,180

[45] Date of Patent: May 27, 1997

[54] METHOD FOR BLOCKING UNWANTED LIGHT FROM A PHOTORECEPTOR DRUM

[75] Inventors: Steven Bruce Michlin, 5310 Bentley Ste. 105, West Bloomfield, Mich. 48322; Steven R. Dixon, Allentown, Pa.

[73] Assignee: Steven Bruce Michlin, West Bloomfield, Mich.

[21] Appl. No.: 434,665

[22] Filed: May 4, 1995

[51] Int. Cl.[6] ..... G03G 15/04; G03G 21/00

[52] U.S. Cl. ..... 399/207

[58] Field of Search ..... 355/200, 210, 355/218, 260, 71

[56] References Cited

U.S. PATENT DOCUMENTS

| | | | |
|---|---|---|---|
| 3,671,121 | 6/1972 | Albert | 355/218 |
| 3,981,577 | 9/1976 | Tsilibes | 355/71 X |
| 4,090,788 | 5/1978 | Massengeil | 355/71 |
| 4,305,650 | 12/1981 | Knox | 355/71 X |
| 4,462,677 | 7/1984 | Onoda | 355/71 X |
| 4,470,689 | 9/1984 | Nomura et al. | 355/71 X |
| 4,607,941 | 8/1986 | Honda | 355/210 |
| 4,876,570 | 10/1989 | Iwaya | 355/218 X |
| 5,184,182 | 2/1993 | Michlin | 355/200 X |

*Primary Examiner*—Fred L. Braun

[57] ABSTRACT

A device and method for blocking light from a laser light beam assembly in a printer, copier, or facsimile machine. Light is blocked from contact with the nonprint region of the photoreceptor drum in a toner cartridge to prevent toner spotting on the output paper and toner leakage in the cartridge and machine. A nontransparent piece of plastic material preferably rectangular in shape is sized to block a part of the light access slot on the toner cartridge cover corresponding to the nonprint region of the drum. The device is secured to the underside of the cover. A method for accurately positioning the nontransparent piece of material to block the required part of the access slot uses a long, flat tool of set length. One end of the tool is placed adjacent to a side wall on the right side of the underside of the cover and the tool is layed over the access slot. The nontransparent piece of material is placed adjacent to the opposite end of the tool and secured by an adhesive, such as two-sided tape, to the underside of the cover. Thus, light is blocked on the left end of the access slot for a distance necessary to keep light from contacting the nonprint region of the drum.

3 Claims, 6 Drawing Sheets

METHOD FOR BLOCKING UNWANTED LIGHT FROM A PHOTORECEPTOR DRUM

STATEMENTS AS TO RIGHTS TO INVENTIONS UNDER FEDERALLY SPONSORED RESEARCH AND DEVELOPMENT

NONE

CROSS REFERENCES TO RELATED APPLICATIONS

NONE

BACKGROUND OF THE INVENTION

1. Field of the Invention

This invention relates to solving problems involving a defective laser scanner in laser printers, copiers, and facsimile machines, otherwise known as imaging machines. The problems occur in a high percentage of printers, possibly as high as thirty to forty percent of the Canon SX printers in the field. The problems also occur in the popular HP Series 2 and Series 3 LASERJET printers as well as in some APPLE printers. At the time of this writing, the CANON SX engine printer is the most widely used printer worldwide. The majority of these SX printers are comprised of the mentioned HP LASERJETS Series 2 and 3. Its numbers are diminishing because the OEM manufacturers discontinued manufacturing the SX printer over three years ago. However, the number of these SX printers produced and sold was so high that they will be numerous in the field for quite some time to come. The invention of this application modifies the toner cartridge as an alternative to fixing the laser scanner by replacing the laser light beam assembly.

2. Description of the Prior Art

CANON has designed an all-in-one toner cartridge as in U.S. Pat. No. 4,975,744, issued Dec. 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers began remanufacturing cartridges. These "disposable" cartridges were designed to funcion for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1995. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "OPTIVA" cartridge, further increasing the size as well as credibility of this relatively new industry. However, this industry grew from the all-in-one cartridge shortly after its debut. Before the introduction of the long-life drum, sometimes called the "superdrum" or "duradrum", the SX cartridge would last for around three cartridge remanufaeturing cycles at best, since the maximum useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM (Original Equipment Manufaturer) drum. With the additional developments of drum coatings, originally designed for OEM drums, the long-life drum may last for many additional cycles. Some coatings, in theory, were designed to be sacrificial, and dissolved and removed from over the drum surface every 1–3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartridges with longer cycles, so component improvements are significant. Therefore, avoiding natural problems with prevention means must also be implemented for cartridges of longer life both in longer cycle times and greater number of cycles.

There is a problem in around thirty to forty percent of the SX laser printers. This problem may also occur in other types of dry toner printers, copiers and facsimile machines, which will be categorized as "imaging machines" in this application. The laser light beam of the laser scanner unit hits the photoreceptor drum in areas that are not in the print region of the output page. This discharges, or punches pixels in the latent electrostatic image on the photoreceptor drum. These areas of the photoreceptor drum then attract toner. As the drum rotates, the attracted toner is scraped into the waste toner hopper of the cartridge, overfilling a region on the left side (usually) of the waste toner hopper and eventually leaking out into the imaging machine. The toner leakage causes additional problems. For example, toner spotting or streaking will develop on the left side or margin of the output page in what is supposed to be a nonprint region. The nonprint region typically consists of an one eighth inch margin around all four edges of the paper. It happens that the problem, however, is most prevalent on the left side. As the overflow from the waste toner hopper progresses, the toner spotting or streaking may enter the print region of the output paper.

The toner leakage soils the inside of the toner cartridge and the inside of the printer. Once the toner is let loose in the cartridge and printer, side effect problems may occur related to the toner landing on the corona wire, corona wire grid, corona assembly reflective walls, erase lamp, mirrors or any other components.

Cleaning up a toner mess in the toner cartridge and printer is time consuming and cumbersome. Toner cartridges thought to be defective are returned from the customers and replaced at no charge. Most printer technicians have not recognized the cause of these problems and have merely dealt with the symptoms by cleaning the printer and/or putting in a fresh toner cartridge. In fact, many technicians give the customer a free replacement cartridge because they think the problems are caused by recharged toner cartridges. Some very astute printer technicians have recognized the problem with the wobbly laser scanner assembly and have repaired or replaced the laser scanner unit in the printer. But parts and labor for replacing the toner cartridge and replacing or repairing the laser scanner unit are expensive. An improvement to the toner cartridge which prevents toner leakage and spotting or streaking on the output paper of the printer would significantly improve the operation of the cartridge and would reduce the costs of cartridge remanufacturing and printer maintenance. Furthermore, it neutralizes the detrimental effects of the defective laser scanner assembly.

U.S. Pat. No. 5,400,128, granted Mar. 21, 1995 to a coinventor of this application, is relevant for describing the operation of an imaging system.

SUMMARY OF THE INVENTION

Accordingly, it is an object of this invention to prevent toner spotting on the left side or margin of the output paper of an imaging machine and to prevent toner leakage through the toner cartridge and into the imaging machine.

It is a further object of this invention to provide a device and method to block the light from the laser light beam assembly of the imaging machine from hitting the nonprint region of the photoreceptor drum within the toner cartridge.

Another object of this invention is to provide a method to accurately position the light-blocking device on the toner cartridge cover so it blocks the required part of the light access slot without interfering with the rest of the printing operation.

In carrying out this invention in the illustrative embodiment thereof, a nontransparent piece of plastic material with two-sided tape on one side or other form of adhesive is secured by the tape to the underside of the toner cartridge cover in position blocking part of the light access slot at the left end of the slot. In this application, the left end of the access slot and the left side of the toner cartridge cover are defined as the end and side which would be on a cartridge user's left when holding the cartridge for correct insertion into the imaging machine. The nontransparent piece of plastic material is typically rectangular in shape and sized to block only a length of the access slot corresponding to the nonprint region of the photoreceptor drum. Other shapes than rectangular may be used as well, but rectangular is simplest and least expensive to manufacture.

To accurately position the nontransparent piece of plastic material on the underside of the cover, one end of a long, flat tool of set length is placed against a right side wall on the underside of the cover and layed along the access slot. The nontransparent piece of plastic material is put against the opposite end of the tool and secured to the underside of the cover over the left end of the access slot.

The nontransparent piece of plastic material blocks the light from the laser light beam assembly in the imaging machine from hitting the nonprint region of the photoreceptor drum. Toner spotting on the left side of the output paper is prevented. Toner buildup on the left end of the drum, and the resulting overfill of the left side of the waste toner hopper, is also prevented. So there is no toner leakage from the waste toner hopper into the other parts of the cartridge and into the imaging machine, preventing toner mess and further damage to the quality of image produced.

BRIEF DESCRIPTION OF THE DRAWINGS

This invention, together with other objects, features, aspects, and advantages thereof, will be more clearly understood from the following description, considered in conjuction with the accompanying drawings.

COMPLETE DESCRIPTION OF THE PREFERRED EMBODIMENT

Figure 1:
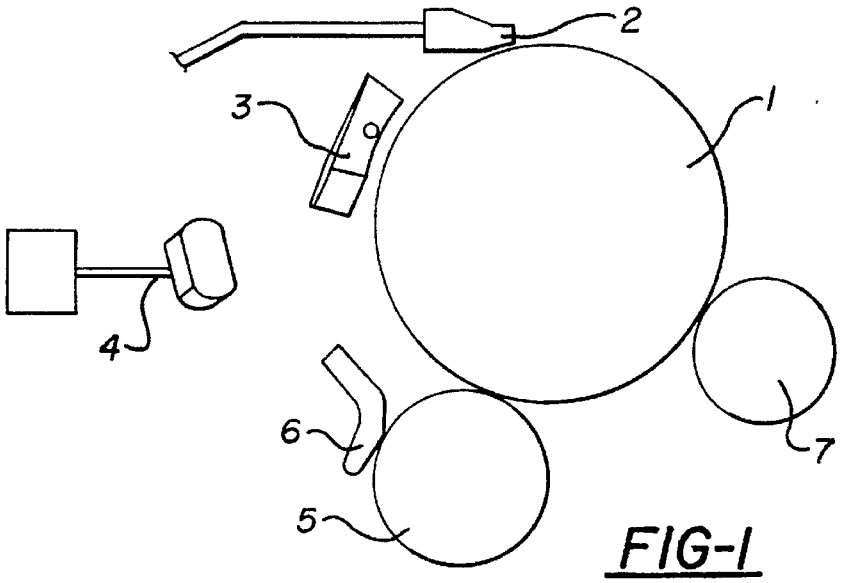
FIG-1 PRIOR ART
FIG. 1 is a broad illustration of some components of the imaging system in end view.

FIG. 1 ia a simplified illustration of some components of the CANON SX imaging system as seen in end view. In forming an image to be printed, remaining toner from the previous rotation of a photoreceptor drum 1 must first be removed from the drum surface. This excess toner is what is left from the production of the previous image and is removed by a wiper blade 2. A corona assembly 3 then charges the photoreceptor drum 1 uniformly across a band to a negative 600 volts DC (direct current). As the photoreceptor drum 1 continues to rotate, the charged band rotates into an imaging zone where it is hit with light from a laser light beam assembly 4 (broadly represented). This creates a latent electrostatic image on the photoreceptor drum 1. This will be described in more detail with regard to FIGS. 2 and 3. But to summarize, the portions of the photoreceptor drum 1 unexposed to the laser light beam remain with the negative potential (−600 V DC) placed there by the corona assembly 3. The portions exposed to the light beam will have been discharged to (−100 V DC), and this is where the invisible latent electrostatic image is formed on the photoreceptor drum 1.

A developer roller 5 has a magnetic core which attracts toner to the surface of the developer roller 5. A spreader blade 6 controls and adjusts the quantity of toner on the developer roller 5 to provide a uniform thickness. The developer roller 5 is connected to a negative DC supply. Some units such as the SX alternatively use a metering doctor blade (not shown) rather than a spreader. The toner particles receive a negative surface charge through a rubbing contact against the developer roller 5. The negative charge on the toner creates an attraction between the toner and the grounded discharge areas of the photoreceptor drum 1 as the photoreceptor drum rotates and the latent image becomes adjacent to the developer roller 5. The negative charge on the toner also causes the toner to be repelled from the negatively charged areas of the drum 1 which have not been exposed to the laser light beam. An AC (alternating current) potential is also applied to the developer roller. This decreases the attraction between the toner and the magnetic core of the developer roller 5 and increases the repelling action of the toner from the photoreceptor drum 1 areas not exposed to the laser light beam. So, the AC potential functions to improve and control the density and contrast of the print on the output pages.

The toner image on the photoreceptor drum 1 is transferred to the paper by a transfer corona or roller 7. Alternately, some imaging machines such as the SX use a transfer corona assembly with wire (not shown). The transfer roller 7 applies a positive charge to the back of the paper, causing the negatively charged toner on the drum 1 to be attracted to the paper. An erase lamp (not shown) would then remove any residual charge or image from the photoreceptor drum 1.

Figure 2:
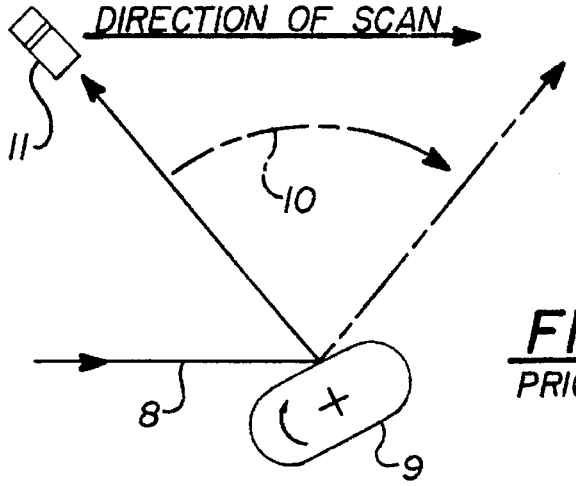
FIG-2 PRIOR ART
FIG. 2 illustrates the conventional rotating scanner mirror of the laser light beam assembly.
Figure 3:
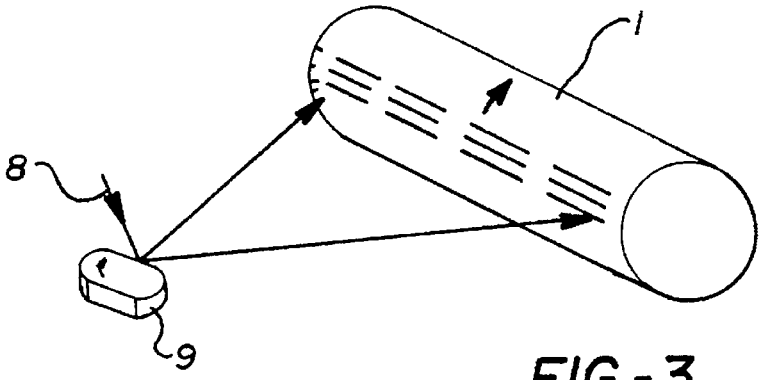
FIG-3 PRIOR ART
FIG. 3 shows the scanner mirror as it aims the laser light beam along the length of the rotating photoreceptor drum.

FIGS. 2 and 3 illustrate the operation of the laser light beam assembly 4. The laser light is produced using a small laser diode which is turned on or off by supplying or denying power to the diode. The direction of the laser light beam 8 is stationary, but it shines onto a rotating two sided mirror 9. As the mirror 9 rotates, the beam 8 reflects off the mirror 9 and sweeps in an arcing motion left to right, as shown by arc arrow 10 in FIG. 2.

The laser light beam 8 is brought into focus on the surface of the rotating photoreceptor drum 1 by a set of focusing lenses (not shown). The beam 8 reaches the photoreceptor drum 1 through an access slot in the side of the toner cartridge. Because the laser light beam 8 sweeps the total length of the photoreceptor drum 1, as shown in FIG. 3, the total circumference of the drum can be covered. The sweeping action of the beam is similar to how a television sweeps its electron beam to form a video image on the screen. The speed of the scanner motor that turns the multiple sided mirror 9 and the speed of the main motor that turns the drum are synchronized so that each successive sweep of the beam 8 is offset 1/300th of an inch. The beam can also be turned on and off to place a dot of light every 1/300th of an inch in a horizontal direction. This is how the printer functions to achieve its 300 dots per inch resolution.

At the start of each sweep before the beam reaches the drum 1, the beam is reflected off of the beam detect mirror 11 into a fiber optics cable. As the momentary pulse of light is directed through the fiber optics cable to a DC controller, it is converted into an electric signal that is used to synchronize the output data for a single scan line sweep. This pulse will then be known as the beam detect signal, which will also be used to diagnose any problems with the laser and/or the scanner motor.

As previously described, the photoreceptor drum 1 is charged uniformly across a band to negative 600 volts DC by the corona assembly 3. Then, as the photoreceptor drum rotates, the charged band rotates into the imaging zone defined by the laser light beam assembly 4, where it is hit with laser light. The laser light hits the drum 1 in little pixels, typically at the 300×300 dots per inch or 90,000 dots per square inch, but sometimes 600×600 dots per inch or 360,000 dots per square inch. It should be noted that this resolution will increase in the future as technology advances.

Each little pixel of light will discharge the drum to negative 100 volts DC. Charge on the drum (−600 V DC) causes white space where as lack of charge on the drum (−100 V DC) causes black space or print. In other words, wherever the photoreceptor drum 1 is charged to negative 600 volts DC will cause white space on the output page. Wherever the photoreceptor drum has been discharged to negative 100 volts DC by the laser light beam 8 will print black. It is very black and white, with no in-between. Shades of grey are made using combinations of these black pixels or dots on a white grid.

Figure 4:
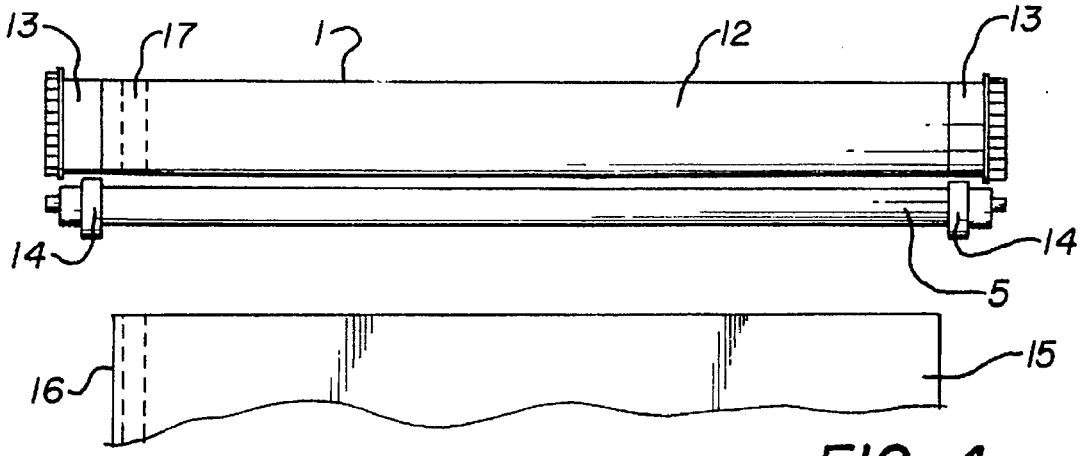
FIG-4 PRIOR ART
FIG. 4 is meant to illustrate the areas on the photoreceptor drum and output paper where the problems prevented by this invention occur.

Since the laser light beam 8 is fixed in direction, the rotating multiple sided mirror 9 positions the pixels of light onto the moving charge band on the photoreceptor drum at the proper time. If either the light beam 8 or the mirror 9 gets out of position, light pixels may hit outside the print region on the photoreceptor drum 1. FIG. 4 is meant to illustrate the problem. The photoreceptor drum 1 is coated with a layer of photoconductive material 12. An uncoated, shiny, silver (bare aluminum) region 13 exists at each end of the drum 1. The developer roller 5 has endfelts 14 which prevent toner leakage from the ends of the roller 5. Toner will be supplied by the developer roller 5 to the photoreceptor drum 1 only from the region between the physical location of the endfelts 14 on the roller 5. The endfelts 14 line up where the uncoated regions 13 meet the photoconductive material 12 on the drum 1 as shown. So when the uncoated regions 13 of the photoreceptor drum 1 receive laser light, there is no effect because the uncoated regions 13 are beyond the toner supply region of the developer roller 5.

The output paper 15 is positioned on the imaging machine such that its left edge 16 is within the region on the drum 1 coated with photoconductive material 12. There is supposed to be a nonprint region 17 on the photoreceptor drum 1 which prevents print from occurring adjacent the left edge 16 of the output paper 15. This nonprint region 17 is the space between the imaginary lines illustrated on the drum 1 and the output paper 15. The laser beam assembly 4, when aligned right and working correctly, is not supposed to hit the photoreceptor drum 1 with light in this nonprint region 17. The nonprint region is around one-eighth of an inch in width and makes sure there is always a left (and right) margin on the output paper of at least one-eighth of an inch where no print occurs.

The nonprint region 17 on the photoreceptor drum 1, and the region to the left of the nonprint region 17 coated with the photoconductive material 12, have a constant supply of toner available. But under normal circumstances these regions stay at negative 600 volts DC because they never receive laser light. However, when a defective laser beam assembly 4 shoots laser lights into these regions, the drum 1 can discharge to the negative 100 volts DC which will cause toner attraction to these regions. The toner may then appear on the output page border adjacent the left edge 16 as dots or sprinkles, reducing the quality of the image produced. Toner on the drum 1 to the left of the nonprint region 17 will remain on the photoreceptor drum 1 after the transfer corona or roller 7 transfers the image from the drum 1 to the output paper 15. As the wiper blade 2 scrapes the excess toner from the drum 1 into the waste toner hopper, toner quickly fills up the left side of the waste toner hopper (where the problem is most prevalent) and eventually leaks out into the cartridge and imaging machine. This causes a great mess and adversely affects the operation of other components of the cartridge.

Figure 5:
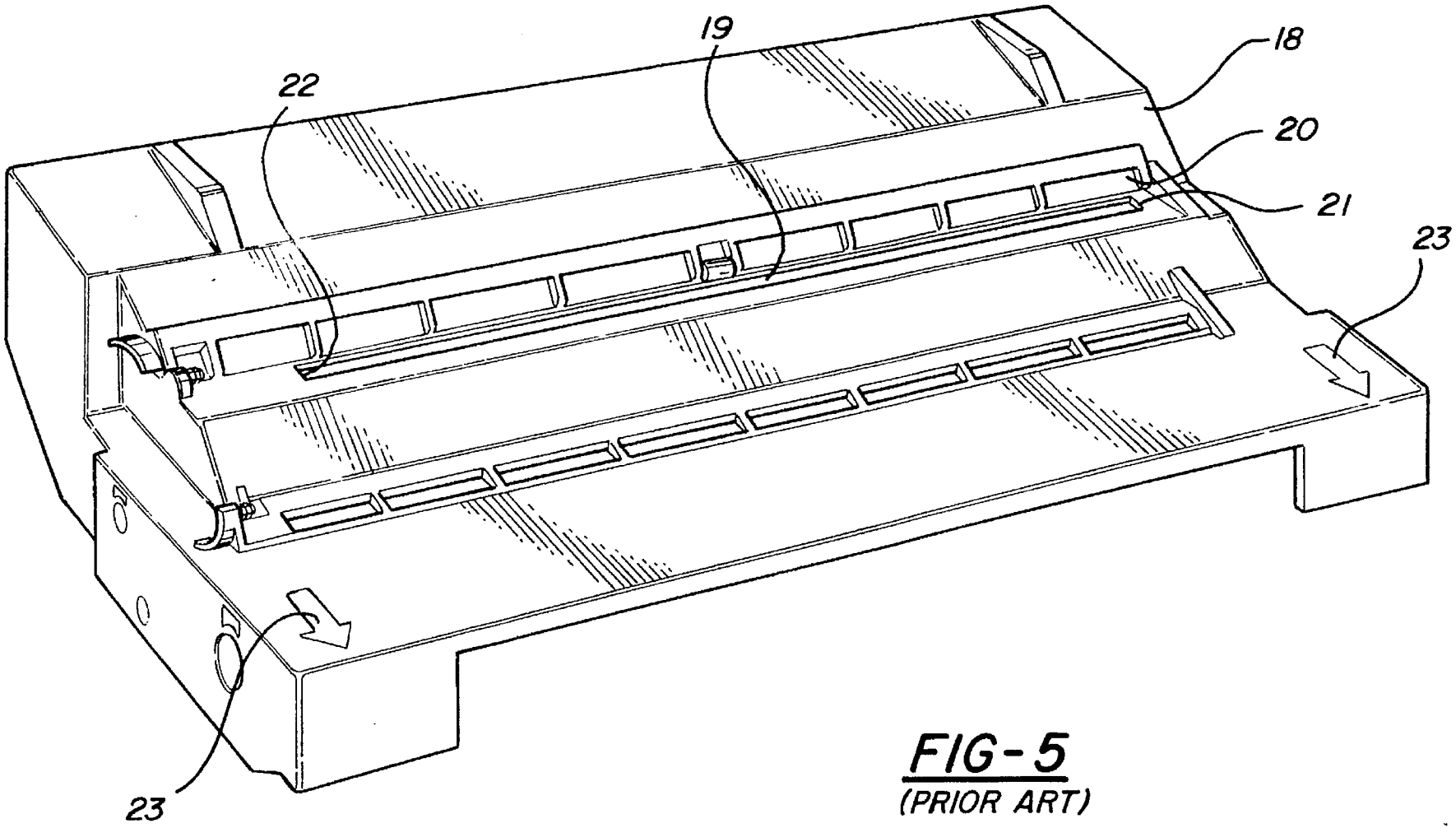
FIG-5 (PRIOR ART)
FIG. 5 shows, in smaller than actual size, a conventional toner cartridge cover.

As an alternative to replacing the toner cartridge or replacing or repairing the laser beam assembly 4, applicants have developed a modification of the toner cartridge which prevents these specific problems of spotted images and toner leakage from the cartridge without having to replace the defective scanning assembly. FIG. 5 shows the top cover 18 of a toner cartridge assembly. There is a laser beam access slot 19 which allows the laser light beam 8 to reach the photoreceptor drum 1 from the laser light beam assembly 4. A hinged cover 20 for the access slot 19 is automatically opened (it is shown in the open position) when the toner cartridge is inserted into the imaging machine. The laser light beam 8 may be focused on the photoreceptor drum 1 over the entire length of the slot 19 from the left end 21 to the right end.

The left end 21 of the access slot 19, though shown on the right side of FIG. 5, would be on the left of a user as the user inserts the cartridge into the machine according to the arrows 23. In other words, FIG. 5 is shown from a different angle. The left side of the cartridge cover 18 is shown on the right side of FIG. 5. The left end 21 of the access slot 19 is the location where a defective laser beam assembly 4 would cause toner attraction to the nonprint region 17 (and to the region on the drum 1 to the left of the nonprint region 17). In other words, there is supposed to be a space or short length of slot at the left end of the access slot 19 where the laser light beam assembly 4 is designed not to direct the laser light beam 8, but this condition does not always occur, especially in the case of a defective scanner assembly.

Figure 6:
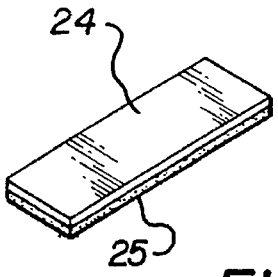
FIG. 6 illustrates the invention of this application.
Figure 7:
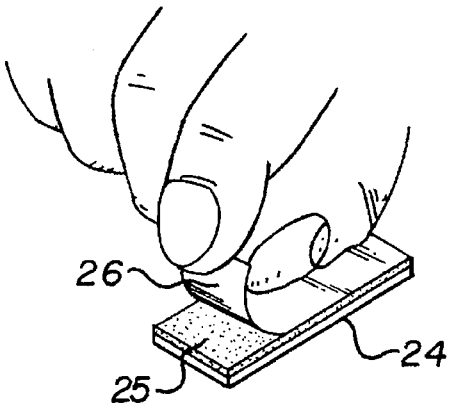
FIG. 7 shows the adhesive side of the light-blocking device of this invention.

FIG. 6 illustrates the invention of this application. It comprises a light-blocking device 24. The light-blocking device 24 is a rectangular piece of nontransparent material with an adhesive 25 on one side. In the preferred embodiment, the light-blocking device 24 is plastic and colored black to match the toner cartridge cover 18, and the adhesive 25 is a two-sided tape. As shown in FIG. 7, the two-sided tape 25 could have a nonstick backing 26 on the exposed side which is peeled off prior to securing the device 24 to the cover 18. Other types and colors of materials may be used as long as they block laser light, and other adhesives such as glue may be used. The light-blocking device 24 is approximately one and one-quarter inches long and one-half of an inch wide. It has a very small width so as not to interfere with the operation of any components within the toner cartridge.

Figure 8:
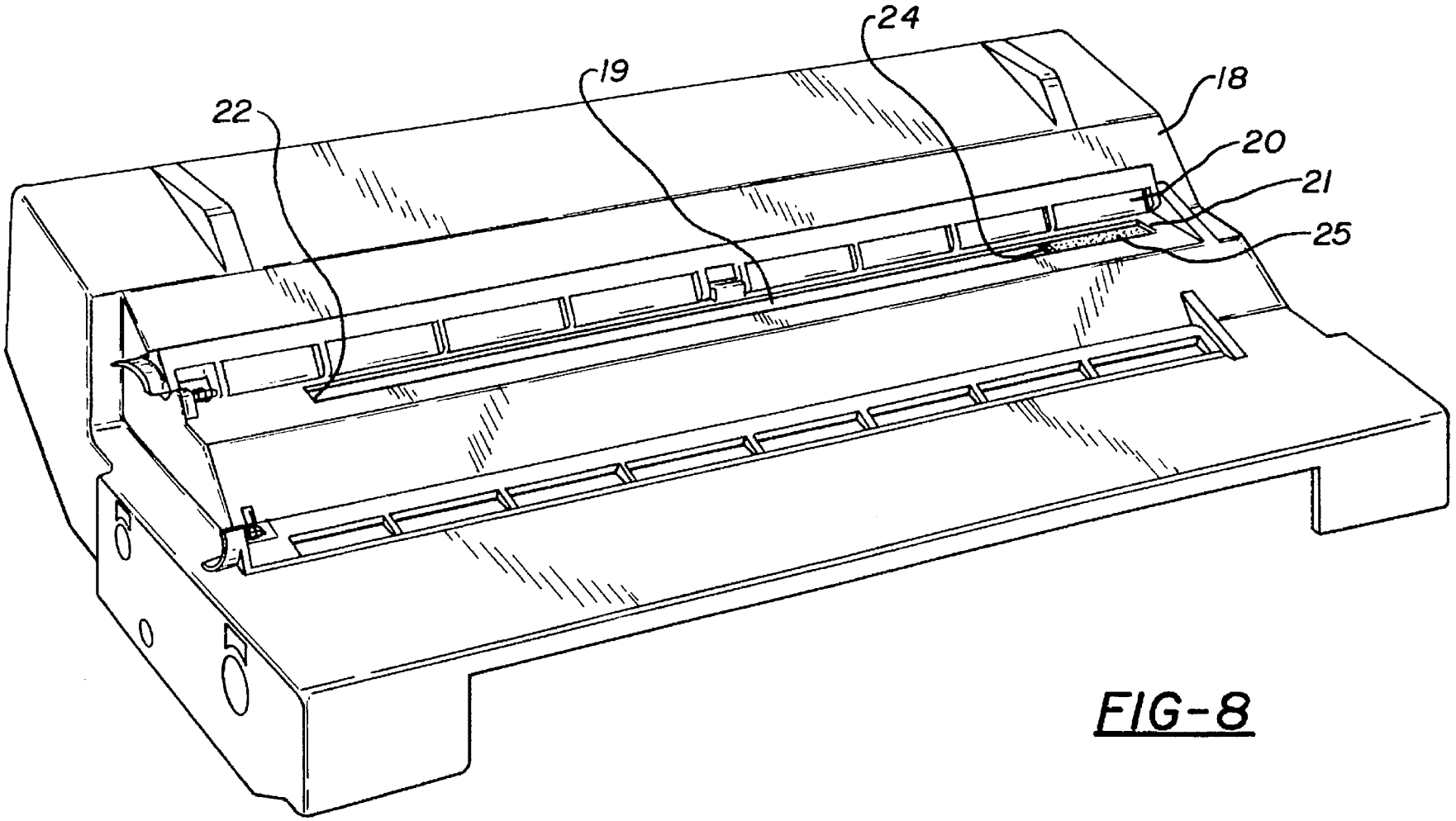
FIG. 8 illustrates the light-blocking device in position on the toner cartridge cover.

FIG. 8 shows the light-blocking device 24 in position at the left end 21 of the access slot 19. The light-blocking device 24 is barely visible here and will be more clear in FIG. 9.

It blocks the access slot 19 for a length of approximately seven-eighths of an inch when positioned correctly. The light-blocking device 24 is secured by the adhesive 25 to the underside of the access slot 19. The object is to have the device 24 stop the laser light beam 8 from shining on the photoreceptor drum 1 until the beam 8 reaches the left edge of the nonprint region 17 of the drum. This ensures that no toner is attracted to the nonprint region 17 of the photoreceptor drum 1 and the area of the drum 1 to the left of the nonprint region 17.

Figure 9:
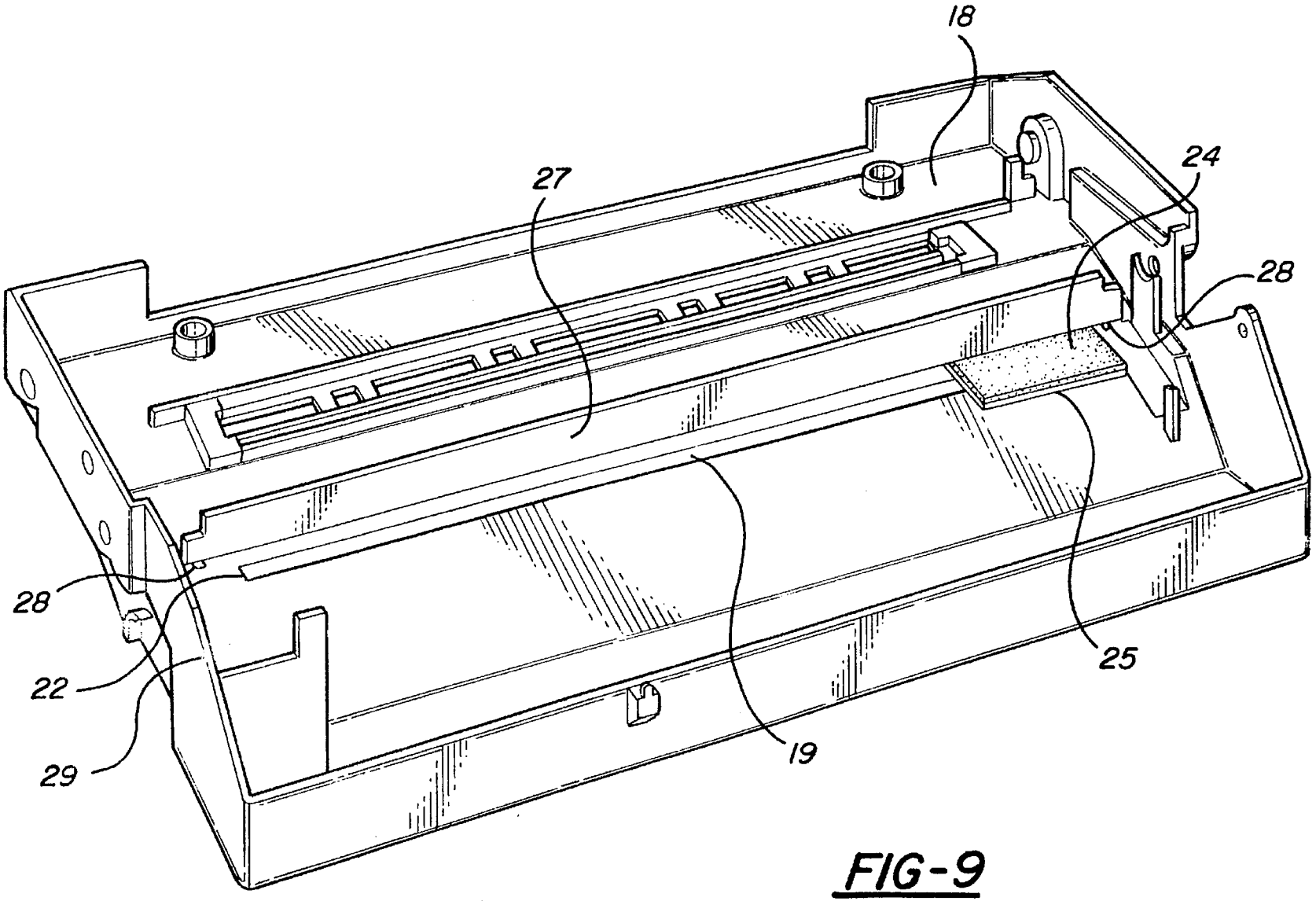
FIG. 9 shows the light-blocking device in position relative to the underside of the toner cartridge cover.

FIG. 9 shows the shows the toner cartridge top cover 18 flipped over (but not turned end for end), revealing the underside of the cover. There is a narrow platform 27 which extends from the cover at a right angle from the plane of the access slot 19 to confine the laser light beam 8 to the charged band on the drum 1. Tabs 28 on each end of the platform 27 appear to help secure or strengthen the connection between the platform 27 and the underside of the cover 18. The reason this structure is mentioned because the tab 28 adjacent the left end 21 of the access slot 19 puts a constraint on the length of the light-blocking device 24. The device 24 has to extend from adjacent the left tab 28 on the cover 18 and be of the correct length to block the laser light beam 8 until the beam 8 reaches the right edge of the nonprint region 17 of the photoreceptor drum 1. This does not necessarily mean the light-blocking device 24 should abut against the edge of the left tab 28. The left tab 28 may be in a different location on different toner cartridge covers 18 since, over the years, many versions have been put into circulation, with the tab 28 in differing locations in many versions. Some versions do not even have the tab 28. Over the years, perhaps over 50 million SX toner cartridges have been put into circulation. Of all these cartridges, nobody prior has ever noticed this simple solution.

Figure 10:
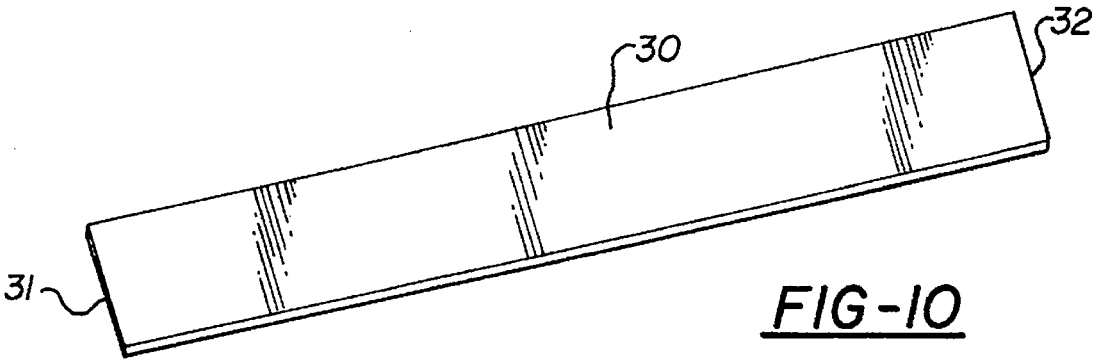
FIG. 10 shows a tool, smaller than actual size, used to accurately position the light-blocking device on the underside of the toner cartridge cover.
Figure 11:
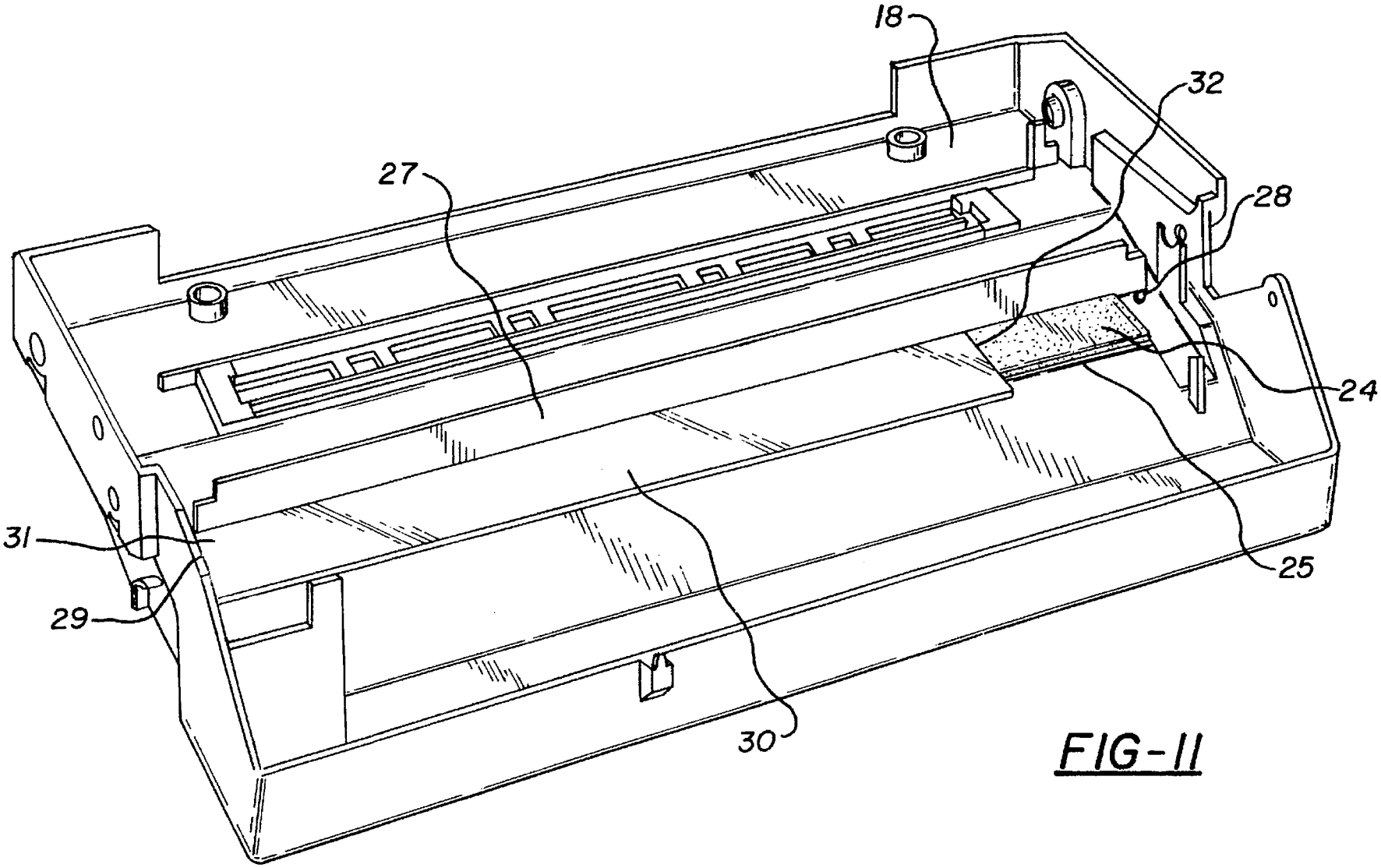
FIG. 11 demonstrates how the tool is used to accurately position the light-blocking device.

There is a side wall 29 extending at a right angle from the plane of the access slot 19 on the right side of the underside of the toner cartridge cover 18. FIG. 10 shows a long, flat, rectangular piece of material, preferably light plastic, which is used as a tool 30 to properly position the light-blocking device 24. The tool 90 is about nine and five-sixteenths inches long and three-quarters to one inch wide. The width is less important. The right end 31 of the tool 30 is put against the side wall 29 on the right of the underside of the toner cartridge cover 18, as demonstrated in FIG. 11, and the tool 30 is layed flat over and along the access slot 19. The light-blocking device 24 is put against the left end 32 of the tool 30 and secured by the two-sided tape 25 to the surface areas adjacent the perimeter of the access slot 19. The tool 30 is then removed. The light-blocking device 24 is thereby accurately positioned quickly and easily. The light-blocking device 24 blocks laser light from hitting the photoreceptor drum 1 until the laser beam 8, during its scan, reaches the right side of the nonprint region 17, regardless of the location of the left tab 28 of the platform 27 on the underside of the cover 18.

The inventors of this invention have recognized the cause of the toner spotting and toner leakage problems and have realized the problems may be prevented by simply blocking the laser light in such a way that it cannot hit the nonprint region 17 of the photoreceptor drum 1. Though many toner cartridge technicians directly deliver toner cartridges to their customers, some ship their toner cartridges all over the world to areas outside their locale. These toner cartridge technicians may never see or meet their customers. It puts these technicians at a disadvantage in terms of competing against technicians who actually go to the customers using location. By using the light-blocking device 24 of this invention, the mail order technicians would be better able to compete against the local technicians because he would not have to worry about having to replace the laser light beam assembly or having to immediately provide replacement toner cartridges. Of course, a local printer technician would also find this invention useful for saving labor and money. Since the small light-blocking device 24 is significantly less expensive than to replace the laser scanning assembly.

Since only certain of the SX printers have these problems of toner spotting on the output paper and toner leakage into other parts of the cartridge and from the cartridge into the printer, a test has been devised for identifying these printers. First, one must print with the printer in question. In the middle of the print page, the printer power is turned off. The door of the printer is opened and the toner cartridge is removed from the printer. Then the drum shutter door of the toner cartridge is opened and the left side of the photoreceptor drum carefully examined. Specifically, the image, in the form of toner on the photoreceptor drum, is carefully observed on the left side of the drum. If the printer has this laser beam problem, a line, band or shading of toner would be observed on the left side of the drum in the nonprint region. If this band of toner exists, it will show up as spotting in the left margin of the output paper, and eventually the toner cartridge and printer will be soiled with toner.

Since minor changes and modifications varied to fit particular operating requirements and environments will be understood by those skilled in the art, the invention is not considered limited to the specific example chosen for purposes of illustration. The invention includes all changes and modifications which do not constitute a departure from the true spirit and scope of this invention as claimed in the following claims and as represented by reasonable equivalents to the claimed elements.

What is claimed is:

1. A method for modifying a toner cartridge assembly to prevent light emitted from a laser beam assembly on an imaging machine from hitting the non-print region of a photoreceptor drum in the toner cartridge assembly, the toner cartridge being of the type including an access slot for allowing light to contact the photoreceptor drum, the access slot including a first region corresponding to the nonprint region of the photoreceptor drum and a second region corresponding to a print region of the photoreceptor drum, and the cartridge including a cover with an underside and with a sidewall near the second region of the access slot, said method comprising:

covering the first region of the access slot by securing a non-transparent member to the cartridge over the first region of the access slot without covering the second region of the access slot;

securing the non-transparent member to the underside of the cover adjacent a first end of the access slot; and positioning the non-transparent member by putting one end of a tool of set length against the side wall and laying the tool along the access slot, then putting the non-transparent member against an opposite end of the tool and securing the non-transparent member to the underside of the cover in position blocking the access slot adjacent the nonprint region of the photoreceptor drum.

2. A method as in claim 1 including applying adhesive on one side of the non-transparent member and using the adhesive to secure the nontransparent member to the underside of the cover.

3. A method as in claim 2 wherein the adhesive is two-sided tape with a nonstick backing on an exposed side which is peeled off prior to securing the nontransparent member to the underside of the cover.

* * * * *